US008857480B2

(12) United States Patent
Sullivan et al.

(10) Patent No.: US 8,857,480 B2
(45) Date of Patent: Oct. 14, 2014

(54) SYSTEM AND METHOD FOR FILLING A PLURALITY OF ISOLATED VEHICLE FLUID CIRCUITS THROUGH A COMMON FLUID FILL PORT

(75) Inventors: Scott C. Sullivan, Clinton Township, MI (US); Douglas Fansler, St. Clair, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 836 days.

(21) Appl. No.: 13/005,759

(22) Filed: Jan. 13, 2011

(65) Prior Publication Data

US 2012/0180898 A1 Jul. 19, 2012

(51) Int. Cl.
*B65B 1/04* (2006.01)
*F16K 1/00* (2006.01)
*F01P 11/02* (2006.01)

(52) U.S. Cl.
CPC ..... *F01P 11/0204* (2013.01)
USPC ..... 141/301; 141/1; 141/99; 141/234; 251/319

(58) Field of Classification Search
CPC ..... F01P 7/165; F01P 7/14; F16K 11/07; F16K 31/0655
USPC ..... 141/1, 99, 234, 301; 220/86.2; 123/41.31; 62/259.2; 251/318–324, 251/337
See application file for complete search history.

(56) References Cited

U.S. PATENT DOCUMENTS 2,633,098 A * 3/1953 Ellis ..... 116/70
3,272,085 A * 9/1966 Hajma ..... 91/420
3,425,400 A * 2/1969 Scherenberg ..... 123/41.08
3,429,340 A * 2/1969 Kosmalski et al. ..... 137/625.65
3,752,132 A * 8/1973 Bentz et al. ..... 123/563
4,036,467 A * 7/1977 Dalton ..... 251/14
4,234,015 A * 11/1980 Kintner ..... 137/625.18
4,348,991 A * 9/1982 Stang et al. ..... 123/41.29
4,370,950 A * 2/1983 Furukubo ..... 123/41.08
4,620,509 A * 11/1986 Crofts ..... 123/41.1
6,182,618 B1 * 2/2001 Gutierrez, Jr. ..... 123/41.29
6,340,006 B1 * 1/2002 Malatto et al. ..... 123/41.29
6,491,001 B1 * 12/2002 Dean et al. ..... 123/41.31
6,607,142 B1 8/2003 Boggs et al.
6,616,059 B2 * 9/2003 Sabhapathy et al. ..... 237/12.3 B
6,705,254 B1 3/2004 Grabowski et al.
6,761,321 B2 * 7/2004 Takahashi ..... 236/34.5
6,902,143 B2 * 6/2005 Domke et al. ..... 251/129.03
7,051,761 B2 * 5/2006 Enzinna et al. ..... 137/625.48
7,182,049 B2 * 2/2007 Wikstrom ..... 123/41.31
7,261,068 B1 * 8/2007 Wantschik ..... 123/41.29
7,549,911 B2 * 6/2009 Nguyen ..... 451/101
7,717,069 B2 * 5/2010 Mokire et al. ..... 123/41.31
7,762,313 B2 * 7/2010 Darby ..... 165/11.1
8,215,427 B2 * 7/2012 Rouaud et al. ..... 180/65.27
8,499,869 B2 * 8/2013 Cimatti et al. ..... 180/68.1
2003/0127528 A1 7/2003 Sabhapathy et al.
2007/0137909 A1 * 6/2007 Zillmer et al. ..... 180/65.2
2009/0249807 A1 * 10/2009 Nemesh et al. ..... 62/117
2012/0067562 A1 3/2012 Cregut et al.
2012/0073664 A1 * 3/2012 Mensch ..... 137/1

* cited by examiner

*Primary Examiner* — Timothy L Maust
(74) *Attorney, Agent, or Firm* — Quinn Law Group, PLLC

(57) ABSTRACT

A vehicle having multiple isolated fluid circuits configured to be filled through a common fill port includes a first fluid circuit disposed within the vehicle, the first fluid circuit having a first fill port, a second fluid circuit disposed within the vehicle, and a conduit defining a fluid passageway between the first fluid circuit and second fluid circuit, the conduit including a valve. The valve is configured such that the first and second fluid circuits are fluidly coupled via the passageway when the valve is open, and are fluidly isolated when the valve is closed.

9 Claims, 3 Drawing Sheets

SYSTEM AND METHOD FOR FILLING A PLURALITY OF ISOLATED VEHICLE FLUID CIRCUITS THROUGH A COMMON FLUID FILL PORT

STATEMENT REGARDING FEDERALLY SPONSORED RESEARCH OR DEVELOPMENT

This invention was made with U.S. Government support under an Agreement/Project number: VSS018, DE-FC26-08NT04386, A000, awarded by the United States Department of Energy. The United States Government may have certain rights in this invention.

TECHNICAL FIELD

The present invention relates generally to fluid systems within an automobile.

BACKGROUND

During the operation of a vehicle, such as an automobile, heat is routinely generated by various components. In many cases, the heat must be removed to ensure the efficient function and/or the durability or longevity of the parts. Due to their unique thermal properties, fluids are often used to absorb thermal energy where it is generated, and to transfer it to a more suitable location where it may be transferred efficiently to the environment. This working fluid may typically be recycled within the cooling system once it has expelled the stored thermal energy. As such, a fluid circuit, such as a closed loop circuit, may be constructed to cycle the working fluid between the heat generating component and the heat expelling component. Such circuits are common in engine block cooling and/or refrigeration applications. In modern automobiles, such as hybrid electric automobiles, multiple fluid circuits may be included, where each circuit may be responsible for heating and/or cooling a particular component or group of components.

SUMMARY

A vehicle having multiple isolated fluid circuits configured to be filled through a common fill port may include a first fluid circuit disposed within the vehicle, the first fluid circuit having a first fill port, a second fluid circuit disposed within the vehicle, and a conduit defining a fluid passageway between the first fluid circuit and second fluid circuit, the conduit including a valve. The valve is configured such that the first and second fluid circuits are fluidly coupled via the passageway when the valve is open, and are fluidly isolated when the valve is closed.

The first and second fluid circuits may be further configured such that fluid provided via the first fill port enters both of the first and second fluid circuits when the valve is open. Each of the first and second fluid circuits may include a respective fluid reservoir, heat exchanger, and thermal component, and at least one of the first or second fluid circuits may be configured to cool an engine block of an internal combustion engine, or a rechargeable energy storage system. Additionally, in an embodiment, the second fluid circuit may include a second fluid fill port. The first and second fluid circuits both may be filled by providing a fluid via one of the first and second fill ports.

The valve may include a plunger that is configured to be depressed by a user, and once depressed, the plunger may close the valve by physically impeding fluid flow through the fluid passageway. The valve may also include a retaining clip that inhibits the plunger from moving away from the depressed state.

A method of filling a plurality of isolated automotive vehicle fluid circuits through a common fluid fill port may include providing a first fluid circuit within an automotive vehicle, where the first fluid circuit may have a first fluid fill port, providing a second fluid circuit within the automotive vehicle and in fluid communication with the first fluid circuit, and providing a valve in fluid communication with the first and second fluid circuit. The valve may be configured to fluidly couple the first and second fluid circuits while open, and may fluidly isolate the first and second fluid circuits while closed. The method may further include filling the first and second fluid circuits with a fluid via the first fluid fill port, and closing the valve to selectively isolate the first fluid circuit from the second fluid circuit.

The above features and advantages and other features and advantages of the present invention are readily apparent from the following detailed description of the best modes for carrying out the invention when taken in connection with the accompanying drawings.

DETAILED DESCRIPTION

Figure 1:
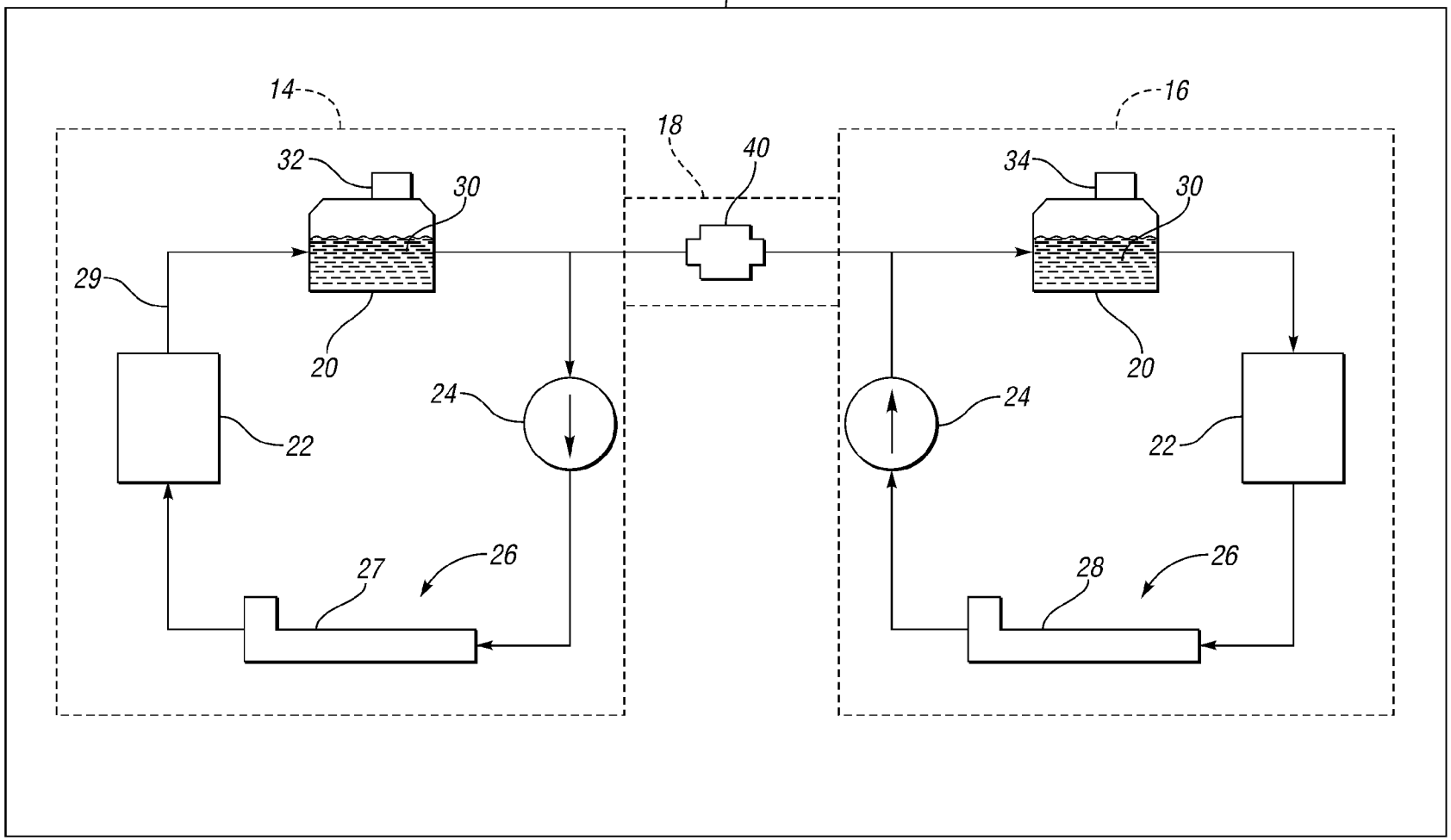
FIG. 1 is a schematic diagram of a plurality of fluid circuits disposed within an automobile and coupled via a conduit.

Referring to the drawings, wherein like reference numerals are used to identify like or identical components in the various views, FIG. 1 schematically illustrates a vehicle 12 having multiple isolated fluid circuits configured to be filled through a common fill port. As shown, the vehicle 12 (e.g., an automotive vehicle) may include a first fluid circuit 14, a second fluid circuit 16, and a conduit 18 that may define a fluid passageway between the first fluid circuit 14 and second fluid circuit 16. The fluid circuits 14, 16 may be disposed, for example, within an engine compartment of the vehicle 12 or under a portion of the vehicle 12 body frame.

In general, each fluid circuit 14, 16 may define a closed loop fluid path, and may be constructed from a plurality of tubular members or chambers that are sealed from the external environment. Each fluid circuit 14, 16 may be configured to use the heat absorption qualities of a fluid contained within the circuit to move heat from one physical location to another. As such, the fluid circuits may be configured to transfer thermal energy from a heat-generating component to the environment, from a heat-generating component to another heat-absorbing component, or from the environment to a heat-absorbing component.

As illustrated in FIG. 1, each fluid circuit 14, 16 may include a respective fluid reservoir 20, heat exchanger 22, pump 24 and thermal component 26, which may all be connected in a series arrangement by tubing 29 or piping. During operation, each circuit 14, 16 may contain a fluid 30 that may pushed and/or pulled through the circuit by the pump 24. As known in the art, the fluid 30 may be operative to, for example, extract heat from the thermal component 26 and expel the heat via the heat exchanger 22. In an embodiment, the heat exchanger 22 may include a radiator. The fluid reservoir 20 may provide a means for the fluid 30 to thermally expand/contract without creating an undue pressure on the tubing 29 or other components within the circuit.

The first and second fluid circuits 14, 16 may be used to heat and/or cool different thermal components 26 that may operate at substantially different temperatures. For example, the first fluid circuit 14 may be configured to cool the engine block 27 of an internal combustion engine, which may operate at a relatively high temperature, while the second fluid circuit 16 may be used to cool a rechargeable energy storage system 28 (e.g., a hybrid vehicle battery), which may operate at a much lower temperature. Accordingly, the size of the reservoir 20, heat exchanger 22, and pump 24 within each circuit 14, 16 may be specifically configured as known in the art to accommodate the thermal demands/requirements of the component 26. It may also be appreciated that the fluid 30 within each circuit 14, 16 may have a substantially different operational temperature range based on the nature and use of the particular fluid circuit.

Each fluid circuit 14, 16 within the vehicle 12 may include a respective fluid fill port 32, 34. A fill port may allow a person, such as a technician or assembler, to fill the circuit with the fluid 30 necessary for operation. In an embodiment, a fluid circuit may be filled by first creating a vacuum within the circuit, and then by providing a fluid 30 into the evacuated circuit via the fill port. While the step of evacuation is not specifically necessary, it is often performed to reduce the likelihood of air pockets being trapped within a fluid line or component.

In an embodiment, the first and second fluid circuits 14, 16 may be configured so that fluid provided via the first fill port 32 may enter both of the first and second fluid circuits 14, 16. By filling both circuits 14, 16 through a single fill port, this configuration may reduce the number of processes needed during initial manufacturing (i.e., from two separate fills to one). Correspondingly, it may also reduce the need for redundant capital equipment and fluid fill stations within the assembly plant. To provide for the fluid coupling between the first and second fluid circuits 14, 16, the vehicle 12 may include a conduit 18 that may define a fluid passageway between the circuits 14, 16. During the filling operation, the conduit 18 may allow fluid from the first fluid circuit 14 to freely flow into the second fluid circuit 16. More generally, the first and second fluid circuits may be both filled by providing a fluid via one of the first and second fill ports.

As noted above, since each fluid circuit 14, 16 may be maintained within a different temperature range during operation, it may be desirable for the fluids of the first and second circuits 14, 16 to be isolated once filled. To accomplish this, in an embodiment, the conduit 18 may include a valve 40 that may be configured to fluidly couple the first and second fluid circuits 14, 16 via the passageway when the valve 40 is in an open state, and may fluidly isolate the circuits 14, 16 when closed.

Figure 2:
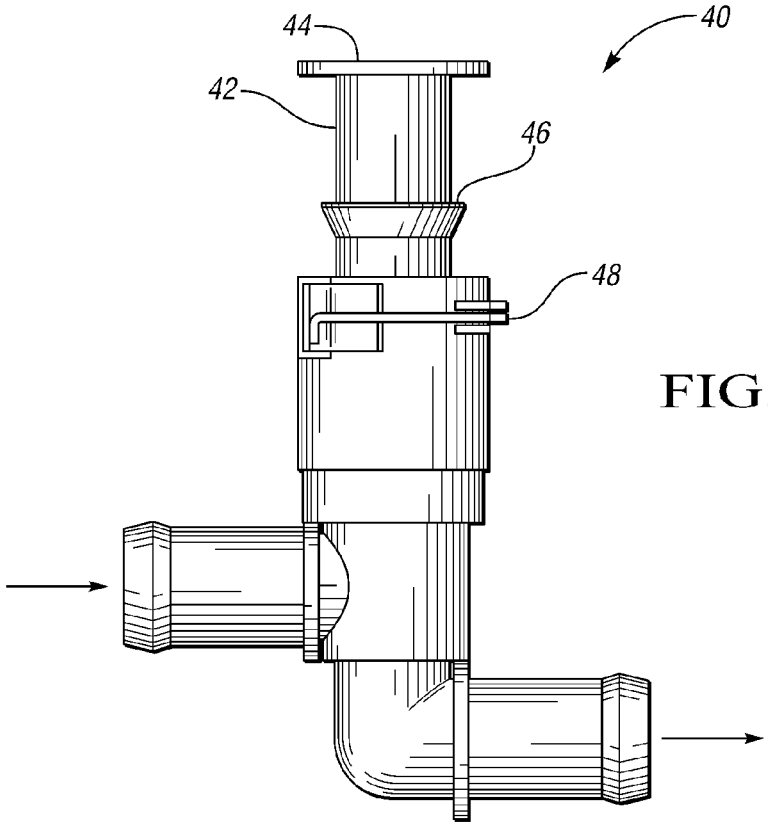
FIG. 2 is a side view of a valve for use in fluidly connecting a first and second fluid circuit.

FIG. 2 illustrates an embodiment of a valve 40 that may be used to isolate the first fluid circuit 14 from the second fluid circuit 16. As illustrated, the valve may include a plunger 42 or other similar actuation means to allow the valve to be selectively closed. In some circumstances, it may be advantageous for the chosen actuation means to require the physical movement of a portion of the valve. Doing so may allow an operator or quality inspector to quickly discern the state of the valve (i.e., open or closed). In an embodiment using a plunger, such as plunger 42, the plunger 42 may be configured to be manually depressed by applying a force to a top surface 44 of the plunger 42. This action may be performed by a person such as an assembler or technician. Once the plunger 42 is depressed, a ridge 46 of the plunger 42 may be configured to engage a retaining clip 48 and may inhibit the plunger 42 from moving away from the depressed state.

Figure 3:
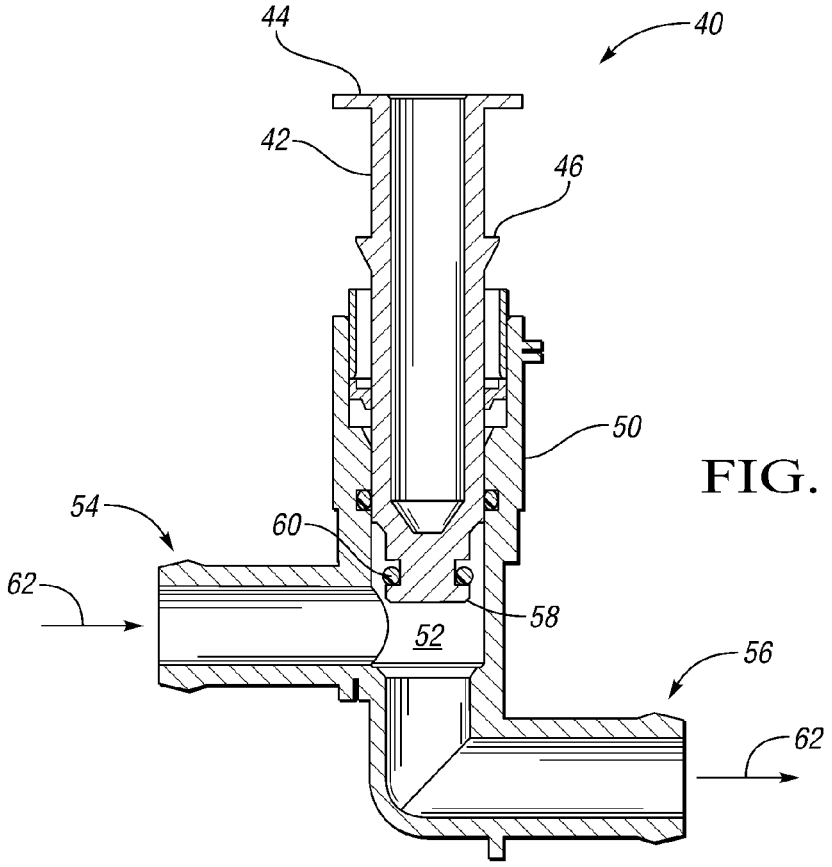
FIG. 3 is a schematic cross-sectional view of the valve illustrated in FIG. 2, represented in an open configuration.
Figure 4:
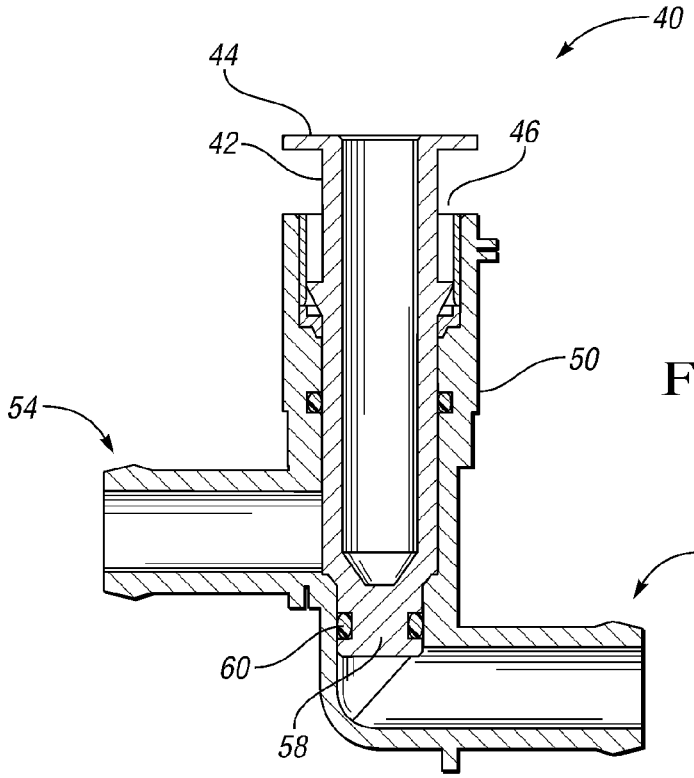
FIG. 4 is a schematic cross-sectional view of the valve illustrated in FIG. 2, represented in a closed configuration.

FIG. 3 illustrates a cross sectional view of the valve 40 shown in FIG. 2. The valve 40 includes a valve body 50 and a plunger 42 that is configured to close the valve 40 when depressed. The valve body 50 defines a fluid passageway 52 that may be fluidly connected on a first side 54 with the first fluid circuit 14 and is fluidly connected on a second side 56 with the second fluid circuit 16. When the plunger 42 is depressed, as generally illustrated in FIG. 4, a portion 58 of the plunger 42 may impede fluid flow through the fluid passageway 52 by physically obstructing a substantial portion of the passageway 52. The plunger 42 may further include one or more seals (e.g., o-ring 60) that may provide a further fluid impediment within the passageway 52.

During the filling operation, the valve 40 may be configured in an open position (as generally illustrated in FIG. 3) whereby it does not substantially impede the flow 62 of fluid 30 through the passageway 52 between the first fluid circuit 14 and the second fluid circuit 16. Once the second fluid circuit 16 has been fluidly filled to a suitable operating level (which may be determined by the specifications of the particular system), the valve 40 may be closed as illustrated in FIG. 4. Closing the valve 40 may substantially isolate the first fluid circuit 14 from the second fluid circuit 16, which may minimize and/or eliminate any fluid and/or thermal exchange between the two circuits.

Figure 5:
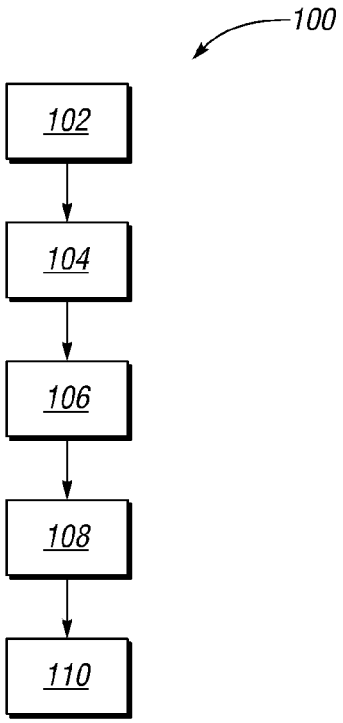
FIG. 5 is a flow diagram of an exemplary method for filling a plurality of isolated automotive vehicle fluid circuits through a common fluid fill port.

FIG. 5 illustrates an exemplary method 100 for filling a plurality of isolated automotive vehicle fluid circuits through a common fluid fill port. In an embodiment, the method 100 includes providing a first fluid circuit within an automotive vehicle, where the first fluid circuit may include a first fluid fill port (Step 102); providing a second fluid circuit within the an automotive vehicle and in fluid communication with the first fluid circuit (Step 104); and providing a valve in fluid communication with the first and second fluid circuit (Step 106). The valve may be configured to fluidly couple the first and second fluid circuits while open, and to fluidly isolate the first and second fluid circuits while closed. The method 100 may further include filling the first and second fluid circuit with a fluid via the first fluid fill port (Step 108), and closing the valve to selectively isolate the first fluid circuit from the second fluid circuit (Step 110).

While the best modes for carrying out the invention have been described in detail, those familiar with the art to which this invention relates will recognize various alternative designs and embodiments for practicing the invention within the scope of the appended claims. All directional references (e.g., upper, lower, upward, downward, left, right, leftward, rightward, above, below, vertical, and horizontal) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not as limiting.

The invention claimed is:

1. A vehicle having multiple isolated fluid circuits configured to be filled through a first fill port, the vehicle comprising:

a first fluid circuit disposed within the vehicle, the first fluid circuit having a first fill port;

a second fluid circuit disposed within the vehicle;

a conduit defining a fluid passageway between the first fluid circuit and second fluid circuit, the conduit including a valve, wherein the valve includes:

a valve body;

a plunger disposed within the valve body and configured to be depressed into the valve body by a user;

wherein depression of the plunger causes the valve to close such that a portion of the plunger impedes fluid flow through the fluid passageway;

wherein the plunger includes a ridge that mechanically inhibits the valve from opening once the plunger is depressed into the valve body;

wherein the first and second fluid circuits are fluidly coupled via the passageway when the valve is open, and the first and second fluid circuits are fluidly isolated when the valve is closed; and wherein the first and second fluid circuits are configured such that fluid provided via the first fill port enters both of the first and second fluid circuits when the valve is open.

2. The vehicle of claim 1, wherein each of the first and second fluid circuits includes a respective fluid reservoir, heat exchanger, and thermal component.

3. The vehicle of claim 1, wherein the second fluid circuit includes a second fill port.

4. The vehicle of claim 1, wherein at least one of the first or second fluid circuits is configured to cool an engine block of an internal combustion engine.

5. The vehicle of claim 1, wherein at least one of the first or second fluid circuits is configured to cool a rechargeable energy storage system.

6. A method of filling a plurality of isolated automotive vehicle fluid circuits through a single fluid fill port; the method comprising:

providing a first fluid circuit within an automotive vehicle, the first fluid circuit having a first fluid fill port operative as the single fluid fill port;

providing a second fluid circuit within the automotive vehicle and in fluid communication with the first fluid circuit;

providing a valve in fluid communication with the first and second fluid circuits, the valve being configured to fluidly couple the first and second fluid circuits while open, and fluidly isolate the first and second fluid circuits while closed;

filling the first and second fluid circuits with a fluid via the first fluid fill port; and closing the valve and inhibiting the valve from opening once the first and second fluid circuits are filled with the fluid to isolate the first fluid circuit from the second fluid circuit.

7. The method of claim 6, wherein each of the first and second fluid circuits include a respective fluid reservoir, heat exchanger, and thermal component.

8. The method of claim 6, wherein the valve includes:

a valve body;

a plunger disposed within the valve body and configured to be depressed into the valve body by a user;

wherein closing the valve includes depressing the plunger such that a portion of the plunger impedes fluid flow through the valve;

wherein the plunger includes a ridge that mechanically inhibits the valve from opening once the plunger is depressed into the valve body.

9. A vehicle having multiple isolated fluid circuits configured to be filled through one of a first and second fill port, the vehicle comprising:

a first fluid circuit disposed within the vehicle, the first fluid circuit having a first fill port;

a second fluid circuit disposed within the vehicle the second fluid circuit having a second fill port;

a conduit defining a fluid passageway between the first fluid circuit and second fluid circuit, the conduit including a valve, wherein the valve includes:

a valve body;

a plunger disposed within the valve body and configured to be depressed into the valve body by a user;

wherein depression of the plunger causes the valve to close such that a portion of the plunger impedes fluid flow through the fluid passageway;

wherein the plunger includes a ridge that mechanically inhibits the valve from opening once the plunger is depressed into the valve body;

wherein the first and second fluid circuits are fluidly coupled via the passageway when the valve is open such that the first and second fluid circuits both may be filled through one of the first and second fill ports;

wherein the first and second fluid circuits are fluidly isolated when the valve is closed; and wherein each of the first and second fluid circuits includes a respective fluid reservoir, heat exchanger, and thermal component, and at least one of the respective thermal components includes an engine block.

* * * * *